US007644847B2

(12) United States Patent
Howell

(10) Patent No.: US 7,644,847 B2
(45) Date of Patent: Jan. 12, 2010

(54) FLEXIBLE PACK FRAME

(76) Inventor: Frank A. Howell, 15 Cotton La., Oxford, ME (US) 04270

( * ) Notice: Subject to any disclaimer, the term of this patent is extended or adjusted under 35 U.S.C. 154(b) by 826 days.

(21) Appl. No.: 11/141,354

(22) Filed: May 31, 2005

(65) Prior Publication Data

US 2006/0266781 A1 Nov. 30, 2006

(51) Int. Cl.
*A45F 3/08* (2006.01)

(52) U.S. Cl. ..... 224/635; 224/633; 224/634; 224/628

(58) Field of Classification Search ..... 224/628–630, 224/633–635
See application file for complete search history.

(56) References Cited

U.S. PATENT DOCUMENTS

| | | | | | |
|---|---|---|---|---|---|
| 2,008,201 | A | * | 7/1935 | Chute | 224/262 |
| 4,040,548 | A | * | 8/1977 | Guglielmo | 224/262 |
| 4,074,839 | A | * | 2/1978 | Wood et al. | 224/635 |
| 4,750,654 | A | * | 6/1988 | Menetrier | 224/630 |
| 4,934,573 | A | * | 6/1990 | Jaeger | 224/628 |
| 5,236,112 | A | * | 8/1993 | Robinson et al. | 224/630 |
| 5,320,262 | A | * | 6/1994 | Levis | 224/630 |
| 5,577,648 | A | * | 11/1996 | Sason et al. | 224/637 |
| 5,762,243 | A | | 6/1998 | McMaster et al. | |
| 5,954,253 | A | * | 9/1999 | Swetish | 224/631 |
| 7,337,935 | B1 | * | 3/2008 | Glanville | 224/628 |
| 2006/0191969 | A1 | * | 8/2006 | Goulding et al. | 224/635 |
| 2008/0149677 | A1 | * | 6/2008 | Howell | 224/633 |

FOREIGN PATENT DOCUMENTS

| | | |
|---|---|---|
| EP | 0748599 | 12/1996 |
| EP | 1481609 | 12/2004 |
| FR | 541360 | 7/1922 |
| GB | 1170604 | 11/1969 |
| GB | 1575250 | 9/1980 |

* cited by examiner

*Primary Examiner*—Nathan J Newhouse
*Assistant Examiner*—John Cogill
(74) *Attorney, Agent, or Firm*—Gauthier & Connors LLP

(57) ABSTRACT

A backpack frame comprises side rails defining a first profile. The first profile has a flat first base segment lying on a first reference plane, and a first concave segment leading from the first base segment to an upper end of the frame, with the first concave segment being spaced a maximum distance from the first reference plane at a first location between the first base segment and the upper end of the frame. An intermediate structure interconnects the side rails. The intermediate structure defines a second profile having a second flat base segment lying on a second reference plane parallel to the first reference plane, and a second concave segment leading from the second base segment to the upper end of the frame, with the second concave segment being spaced a maximum distance from the second reference plane at a second location between the second base segment and the upper end of the frame. The first and second locations are offset from one another.

4 Claims, 2 Drawing Sheets

FLEXIBLE PACK FRAME

BACKGROUND

1. Field of the Invention

The present invention relates to frames for backpacks.

2. Description of the Prior Art

Typically external frame style load bearing pack frames are made of rigid materials such as steel or aluminum. Fabrication techniques used to manufacture these designs generally include cutting, bending, welding and riveting together the component parts. These designs and materials emphasize strength to support heavy loads and rigidity to stabilize those loads while the wearer moves about.

Another approach used more recently is to fabricate external pack frames from molded or formed thermoplastics. These offer the benefits of reduced fabrication costs, yet compromises are made in the strength and rigidity of the frames due to the physical limitations of the polymers used.

With prior approaches that rely on steel or aluminum, there is virtually no flexing of the structure to accommodate the desired range of movements of the wearer. Additionally, straining against the rigid frame creates pressure points on the wearer that will become uncomfortable under prolonged, heavily loaded use. Rigid frame structures are not capable of absorbing catastrophic impact, and can be overwhelmed when dropped or struck. Moreover, rivets will pop, welds crack, and metal breaks when, for example, loaded packs are tossed off of trucks or strike the ground during parachute deployments. Steel or aluminum frames are expensive to manufacture.

Prior approaches that rely on molded or formed thermoplastics also have limitations. For example, frame designs using polymers are not rigid enough for the wearer to stabilize heavy loads while moving about. Thermoplastic frames can flex in unwanted ways at inopportune times, compromising the balance and therefore the safety of the user. Designs that are shaped in a manner to improve rigidity tend to compromise the desired range of motion, move the load's center-of-gravity further away from the wear's own center-of-gravity, and thus negatively impact balance and carrying comfort, creating fit conflicts with items worn on the back such as body armor plates and heavy clothing.

SUMMARY OF THE INVENTION

An objective of the present invention is to provide a lightweight, flexible and sturdy backpack frame that provides sufficient fit and range of motion with varying equipment combinations while maintaining a low cost of manufacture. In one aspect of the present invention, a backpack frame has a varying longitudinal centerline geometry in relationship to the geometry of the outboard longitudinal edges and a recurving longitudinal contour relative to the wearer's back.

The backpack frame of the present invention has side rails defining a first profile. The first profile has a flat first base segment lying on a first reference plane, and a first concave segment spaced a maximum distance from the first reference plane at a first location between the first base segment and the upper end of the frame. An intermediate structure interconnects the side rails. The intermediate structure has a second profile with a second flat base segment lying on a second reference plane parallel to the first reference plane, and a second concave segment leading from the second base segment to the upper end of the frame. The second concave segment is spaced a maximum distance from the second reference plane at a second location between the second base segment and the upper end of the frame. The first and second locations of maximum spacing are offset from one another.

These and other features and objectives of the present invention will now be described in greater detail with reference to the accompanying drawings.

DETAILED DESCRIPTION

Figure 1:
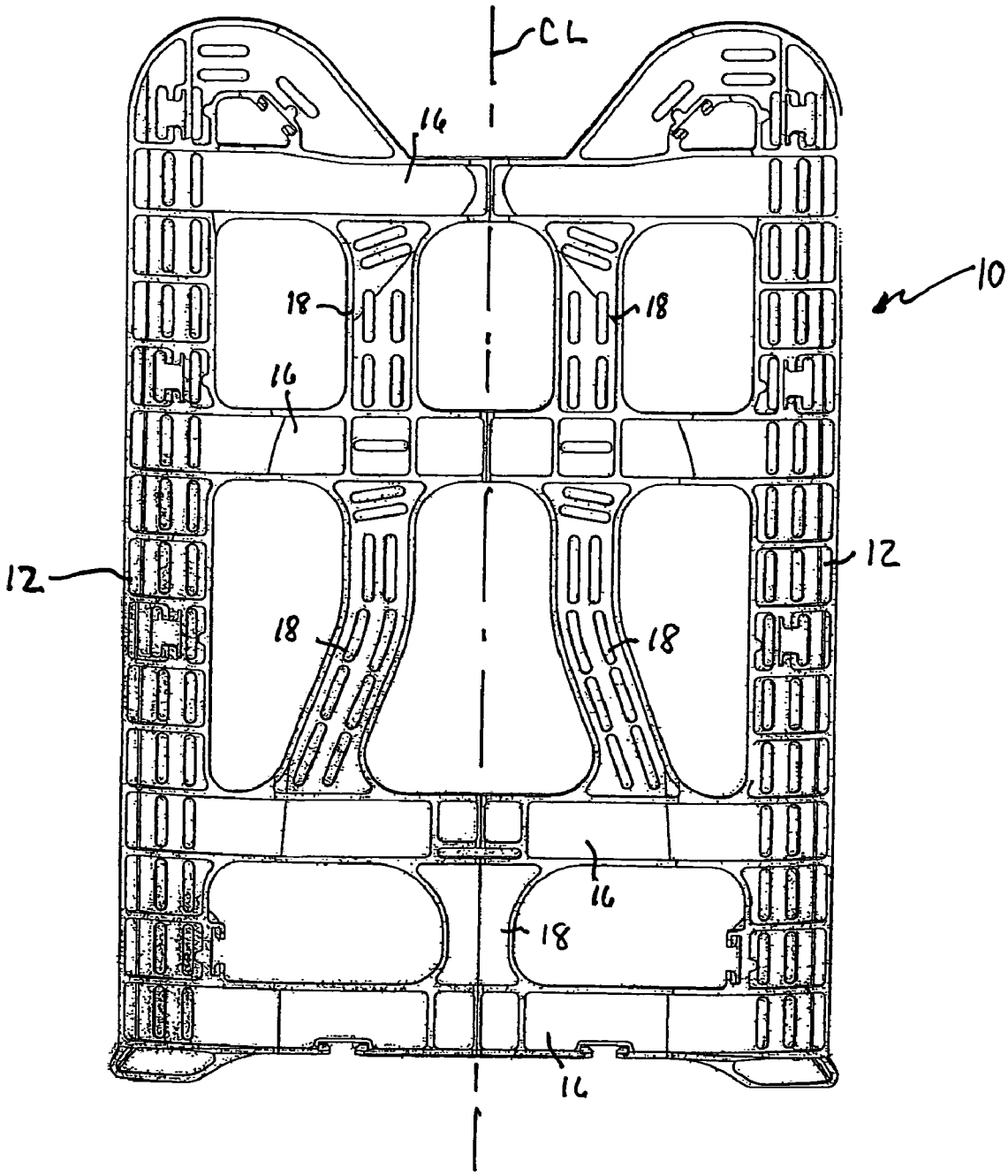
FIG. 1 is a rear view of a backpack frame in accordance with the present invention.
Figure 2:
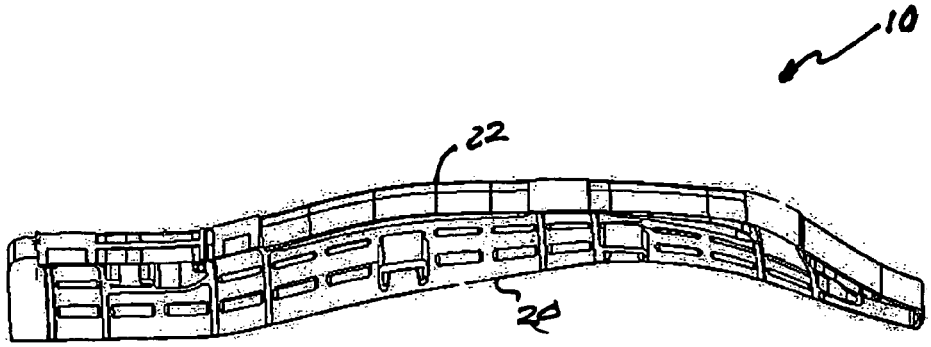
FIG. 2 is a sectional view taken along the centerline of the backpack frame.

Referring initially to FIGS. 1 and 2, a backpack frame in accordance with the present invention is generally depicted at 10. The frame is integrally molded of a high strength flexible thermoplastic with side rails 12 extending in a generally parallel relationship to the frame's centerline CL. The side rails are interconnected by an intermediate structure comprising a lattice network of cross members 16 and generally longitudinally extending ribs 18.

Figure 3:
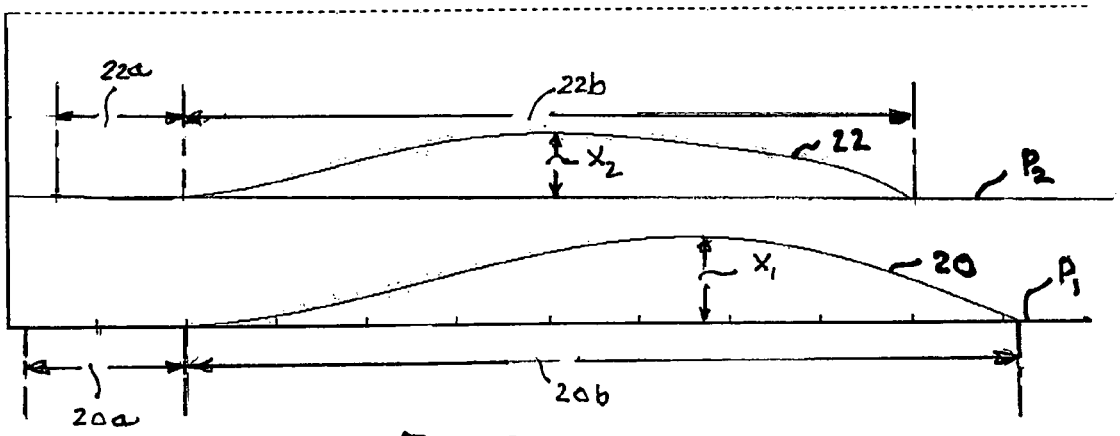
FIG. 3 is a plot of the centerline and outboard edges of the backpack frame.

With reference to FIG. 3, a first plot line 20 depicts a first profile of the frame's side rails 12 in relation to a first reference plane $P_1$, and a second plot line 22 depicts a second profile of the intermediate structure at the centerline CL in relation to a second reference plane $P_2$ parallel to the first reference plane $P_1$.

The first profile 20 has a flat first segment 20*a* lying on the first reference plane $P_1$, and a first concave segment 20*b* leading from the first base segment to an upper end of the frame. The first concave segment is spaced a maximum distance from the first reference plane at a first location $X_1$ between the first base segment 20*a* and the upper frame end.

The second profile 22 has a second flat base segment 22*a* lying on the second reference plane $P_2$, and a second concave segment 22*b* leading from the second base segment to the upper frame end. The second concave segment 22*b* is spaced a maximum distance from the second reference plane at a second location $X_2$ between the second base segment 22*a* and the upper frame end.

The first and second locations $X_1$, $X_2$ are offset one from the other, with the location $X_1$ being closer to the upper frame end.

It will be seen, therefore, that stated in reference to the pack frame carried on a person's back, the profiles at the centerline and the outboard edges draw closer to each other while moving vertically toward the top of the frame. This causes the concavity of the frame relative to the wearer's back to decrease in a specific manner that creates the following benefits:

- The frame fits closer to body allowing the center of gravity of the carried load to be closer to the wearer's own center of gravity. This results in improved balance and allows the load-carrying plane of the frame to stay closer to vertical as the frame passes up over the wearer's scapula.
- It becomes progressively more flexible torsionally moving towards the top of the frame; the reduced concavity allows the frame to twist with shoulders and upper torso while walking, running and climbing.
- When the wearer's back is unusually flat/broad or body armor, heavy clothing, floatation devices, etc. are being worn, the frame contour allows clearance at the outboard edges of the pack frame so that the weight of the pack is not loading only where the outboard edges touch the wearer's back, body armor, heavy clothing, etc.

Progressively reducing the concavity of the pack frame as described above, however, can cause the pack frame to become too flexible in the longitudinal axis for stable load carriage unless another feature is included.

Stated in reference to a pack frame carried on a person's back and starting with the frame's flat base segments 20*a*, 22*a*, the invention overcomes this limitation by progressively curving the frame first away from the plane of the wearer's back and then back toward it again as the concavity defined above is progressively reduced, with the locations $X_1$, $X_2$ of maximum spacing being offset one from the other, and with location $X_1$ being closer than location $X_2$ to the upper end of the frame.

What is claimed is:

1. A backpack frame comprising:

side rails extending from a lower end to an upper edge of said frame, said side rails defining a first profile having a flat first base segment bordering said lower end and lying on a first reference plane, and having a first concave segment leading from said first base segment to and spanning the upper edge of said frame, said first concave segment being spaced a maximum distance from said first reference plane at a first location between said first base segment and the upper edge of said frame; and an intermediate structure interconnecting said side rails, said intermediate structure defining a second profile, said second profile having a second flat base segment bordering said lower end and lying on a second reference plane parallel to said first reference plane, and having a second concave segment leading from said second base segment to and spanning the upper edge of said frame, said second concave segment being spaced a maximum distance from said second reference plane at a second location between said second base segment and the upper edge of said frame;

said second concave segment being arranged to overlap said first concave segment, with said first and second locations being offset from one another.

2. A backpack frame comprising:

side rails extending from a lower end to an upper end of said frame, said side rails defining a first profile having a flat first base segment bordering said lower end and lying on a first reference plane, and having a first concave segment leading from said first base segment to and spanning at the upper end of said frame, said first concave segment being spaced a maximum distance from said first reference plane at a first location between said first base segment and the upper end of said frame; and an intermediate structure interconnecting said side rails, said intermediate structure defining a second profile, said second profile having a second flat base segment bordering said lower end and lying on a second reference plane parallel to said first reference plane, and having a second concave segment leading from said second base segment to and spanning the upper end of said frame, said second concave segment being spaced a maximum distance from said second reference plane at a second location between said second base segment and the upper end of said frame;

each of said maximum distances being measured in a direction perpendicular to the reference planes of the respective profiles, said first and second profiles being spaced one from the other in said direction over their entire lengths, with said first and second concave segments overlapping each other, drawing closer together, and differing in curvature as they progress from their respective base segments to the upper end of said frame, and with said first and second locations being offset from one another.

3. The backpack frame of claim 2 wherein said first location is closer than said second location to the upper end of said frame.

4. A backpack frame comprising:

side rails extending from a lower edge to an upper edge of said frame, said side rails defining a first profile configured with a flat first base segment bordering said lower edge and lying on a first reference plane, and having a first concave segment leading from said first base segment to terminate at the upper edge of said frame, said first concave segment being spaced a maximum distance from said first reference plane at a first location between said first base segment and the upper edge of said frame; and an intermediate structure interconnecting said side rails, said intermediate structure defining a second profile configured with a second flat base segment bordering said lower edge and lying on a second reference plane parallel to said first reference plane, and having a second concave segment leading from said second base segment to terminate at the upper edge of said frame, said second concave segment being spaced a maximum distance from said second reference plane at a second location between said second base segment and the upper edge of said frame;

each of said maximum distances being measured in a direction perpendicular to the reference planes of the respective profiles, said first and second profiles being spaced one from the other in said direction over their entire lengths, with said first and second concave segments overlapping each other, drawing closer together, and differing in curvature as they progress from their respective base segments to the upper edge of said frame, and with said first and second locations being offset from one another.

* * * * *

UNITED STATES PATENT AND TRADEMARK OFFICE

CERTIFICATE OF CORRECTION

PATENT NO. : 7,644,847 B2
APPLICATION NO. : 11/141354
DATED : January 12, 2010
INVENTOR(S) : Frank A. Howell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1033 days.

Signed and Sealed this

Sixteenth Day of November, 2010

David J. Kappos

David J. Kappos
*Director of the United States Patent and Trademark Office*